United States Patent [19]

Ejchorszt

[11] 3,984,879

[45] Oct. 12, 1976

[54] BODY STALL SHOWER STRUCTURE

[76] Inventor: Olgierd Z. Ejchorszt, 5580 Vesuvian Walk, Long Beach, Calif. 90803

[22] Filed: July 14, 1975

[21] Appl. No.: 595,380

[52] U.S. Cl. ..... 4/145; 4/152

[51] Int. Cl.[2] ..... A47K 3/22; A47K 3/08

[58] Field of Search ..... 4/145–158; 239/282, 567, 537, 538, 562, 563, 564

[56] References Cited

UNITED STATES PATENTS

| | | | |
|---|---|---|---|
| 439,793 | 11/1890 | Taylor | 4/152 |
| 803,598 | 11/1905 | Jackson | 4/154 |
| 1,112,261 | 9/1914 | Carter | 4/145 |
| 2,060,100 | 11/1936 | Michelson | 4/148 X |
| 3,724,760 | 4/1973 | Smith | 4/145 X |
| 3,858,252 | 1/1975 | Ejchorszt | 4/145 |

FOREIGN PATENTS OR APPLICATIONS

| | | | |
|---|---|---|---|
| 1,161,218 | 1/1964 | Germany | 4/152 |

*Primary Examiner*—Henry K. Artis
*Attorney, Agent, or Firm*—William C. Babcock

[57] ABSTRACT

A body shower stall that includes a preformed apertured panel as a part thereof, with the discharge of liquid from at least a portion of the apertures being at a pressure dependent on the hydrostatic heads imposed on columns of water rather than line pressure. Discharge of water from the apertures is controlled by a multiposition valve, which may be selectively positioned to permit water discharge from an overhead shower head as well as desired portions of the apertures. The apertures have no projecting portions, and as a result vandalism is held to a minimum when the apertured panel is used in public facilities such as schools, colleges and the like.

4 Claims, 6 Drawing Figures

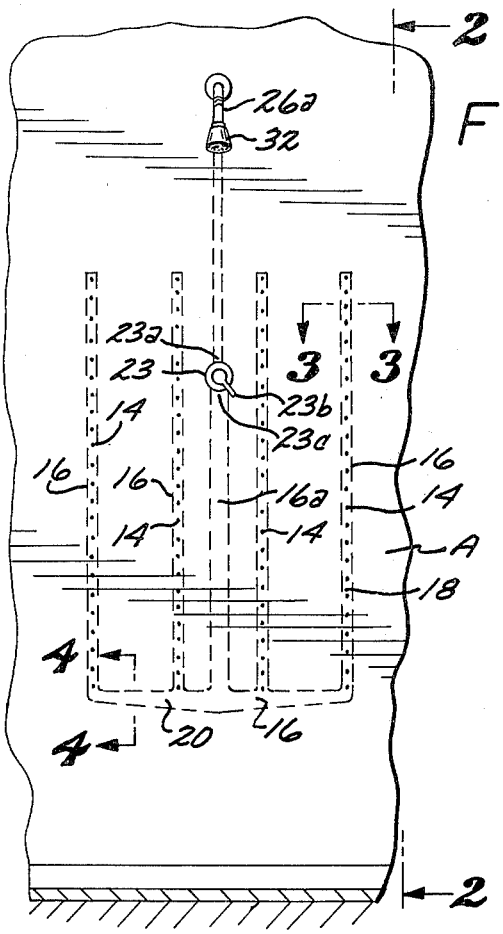
FIG. 1
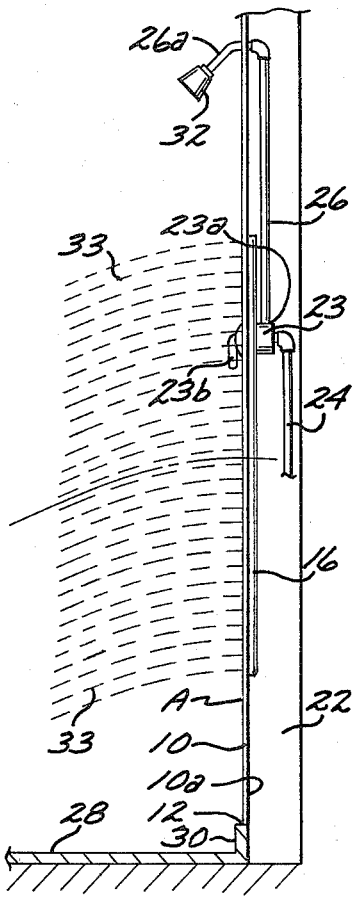
FIG. 2
FIG. 5
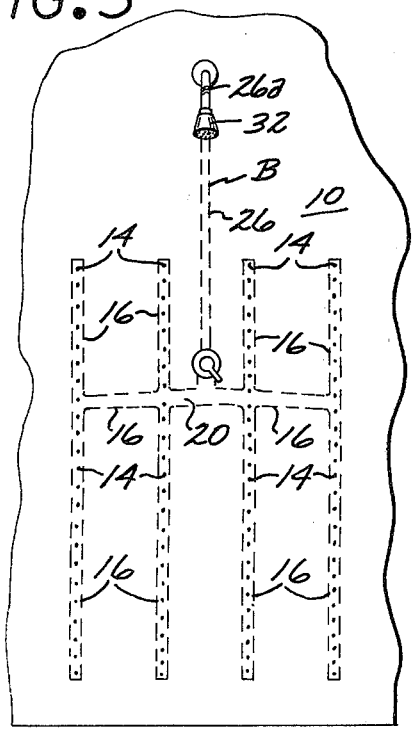
FIG. 3
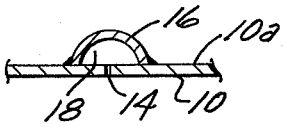
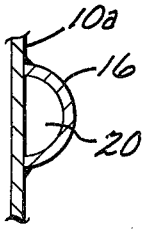
FIG. 4
FIG. 6
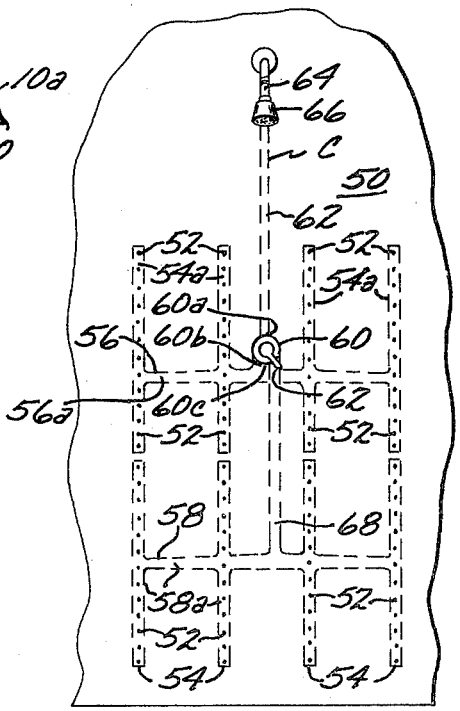

BODY STALL SHOWER STRUCTURE

BACKGROUND OF THE INVENTION

1. Field of the Invention

Body Stall Shower Structure.

2. Description of the Prior Art

In the past, stall showers are constructed in the field as a part of the building in which they are installed, as is the plumbing associated with the shower. Such showers have an elevated shower head through which water is directed downwardly as a number of jets, with the velocity of water in the jets being at least partially controlled by the line pressure of the water supplied thereto. Many persons, particularly women, object to taking a shower in which jets of water are directed downwardly over their heads, particularly when the jets of water are discharged from the shower nozzles at substantially line pressure.

A primary purpose in devising the present invention is to supply a preformed apertured valve controlled panel that may be used to define one wall of a shower enclosure that may be of any desired shape, with the velocity of water from at least a portion of the apertures being dependent on the hydrostatic head of columns of water rather than line pressure, and the apertures of the panel having no projecting portions that may be broken off by vandals.

Another object of the invention is to furnish a panel that may be substantially completed as to plumbing prior to delivery to the building structure in which it is to be installed.

SUMMARY OF THE INVENTION

A preformed, apertured, valve controlled wall panel that may be installed in a building structure to define at least one wall of a shower, or included as a part of an integral shower structure that is delivered as such to a building in which it is to be installed.

The panel is of such structure that a multi-position valve included as a part thereof may selectively direct water at line pressure to an elevated shower head, as well as to a number of spaced apertures at a pressure that is substantially less than line pressure. The panel has a minimum of accessories extending therefrom into the enclosure, and as a result vandalism thereto is substantially reduced in those public installations such as schools or the like in which the invention is installed.

BRIEF DESCRIPTION OF THE DRAWING

FIG. 1 is a front elevation view of a first form of the panel;

FIG. 2 is a vertical cross sectional view of the first form of panel taken on the line 2—2 thereof;

FIG. 3 is a fragmentary transverse cross sectional view of the first form of panel taken on the line 3—3 thereof;

FIG. 4 is a fragmentary vertical cross sectional view of the first form of panel taken on the line 4—4 thereof;

FIG. 5 is a front elevational view of a second form of stall shower panel; and

FIG. 6 is a front elevational view of a third form of stall shower panel.

DESCRIPTION OF THE PREFERRED EMBODIMENTS

The first form of stall shower panel A shown in FIGS. 1 and 2 includes a rectangular sheet 10 of a commercially available polymerized resin that is resistant to both water and dampness. The sheet 10 has a lower edge 12 that is horizontally disposed when the sheet is disposed as shown in FIG. 2. Sheet 10 includes parallel side edges and an upper edge (not shown) that is parallel to lower edge 12. Sheet 10 has a number of vertically aligned rows of transverse apertures 14 therein that are laterally spaced from one another. Conduit defining members 16 of semi-circular transverse cross section are bonded to a rearward face 10*a* of sheet 10 and cooperate with the sheet to define elongate vertically extending confined spaces 18 and a generally horizontal confined space 20 that is in communication with spaces 18. The upper extremities of the members 16 that define vertical confined spaces 18 are closed, as are the free extremities of the member 16 that cooperate with sheet 10 to define horizontal confined space 20.

Sheet 10 is secured to the wall studs 22 of a building (not shown) by conventional means. A multi-position valve 23 is provided that is connected by a pipe 24 to a source of water, with the valve having a first water discharge outlet 23*a* therein connected to a tubular member 26 that extends upwardly adjacent surface 10*a* of sheet 10, and then develops into a forwardly extending portion 26*a* that extends through an opening in the upper portion of sheet 10. The stall shower includes a bottom 28 that has a curb 30 extending upwardly from the peripheral edges thereof. Lower edge 12 of sheet 10 is in sealing abutting contact with the top of curb 30 as shown in FIG. 2. Valve 23 is controlled by a rotatable handle 23*b* that is accessible to a person (not shown) standing in the stall shower B shown in FIG. 2. The stall shower B includes additional panels 10 that form the sidewalls thereof, but which additional panels do not have apertures 14 therein. A shower head 32 is secured to the free end of pipe portion 26*a*.

Valve 23 includes a second water discharge outlet 23C that is connected to a conduit member 16*a* that is in communication with the horizontal conduit 16 as shown in FIGS. 1 and 2. Valve 23 is a four way valve, with the handle 23*b* when in a first position preventing flow of water from pipe 24 to first and second outlets 23*a* and 23*c*. When the handle 23*b* is in a second position, communication is established between water supply pipe 24 and conduit 16*a*. In the third position the handle 23*b* permits flow of water to both conduit 16*a* and pipe 26. The handle 23*b* when in a fourth position obstructs communication between pipe 24 and pipe 26. The valve when in the second and third positions throttles and controls the flow of water to conduit 16*a*. The flow of water to conduit 16*a* may be so regulated that the vertically extending confined spaces 18 have columns of water maintained therein of a desired height. The height of the columns of water determine the vertical number of apertures 14 through which jets of water 32 will discharge. Also, the heights of the columns of water in the vertical confined spaces 18 will determine the hydrostatic pressure on the water defining jets 32 and the velocity at which the jets discharge onto a user in shower B.

A second form B of the shower panel is shown in FIG. 5 that is structurally similar to first form A, but differs from the latter in that the horizontal conduit 16 that defines confined space 20 is intermediately disposed between the upper and lower ends of the conduits 16 that define the vertically extending confined spaces 18. The second form B operates in substantially the same manner and produces substantially the same results as first form A.

A third form C of the stall shower invention is illustrated in FIG. 6 that includes a panel 50 having a number of laterally spaced, vertically extending rows of apertures 52 therein. Conduits 54 are sealed to the rearward surface 50*a* of panel 50 to cooperate therewith to define a number of vertically disposed confined spaces 54*a*. The upper and lower ends of conduits 54 are sealed. Upper and lower horizontal conduits 56 and 58 are secured to the rearward surface 50*a* and provide horizontal confined spaces 56*a* and 58*a* that are in communication with confined spaces 54*a*.

A seven way vaive 60 is provided that is controlled by rotatable handle 62. Valve 60 is supplied water at line pressure from a source (not shown). Valve 60 has first, second and third water outlets 60*a*, 60*b* and 60*c*. First outlet 60*a* is connected to a pipe 62 that extends upwardly adjacent rearward surface 50*a* and develops into a forwardly projecting extension 64 that supports a shower head 66. Second outlet 60*b* is in communication with upper horizontal confined space 56*a*. Third outlet 60*c* is in communication with a pipe 68 disposed adjacent the rearward surface of panel 50, which pipe 68 disposed adjacent the rearward surface of panel 50, which pipe 68 is also in communication with lower horizontal confined space 58*a*.

When handle 62 is in a closed position entry of water at line pressure into valve 60 is obstructed. The handle 62 when in a second position allows water from the supply line (not shown) to flow through valve 60, third outlet 60*c* and pipe 68 to the lower confined space 58*a*.

Handle 62 when pivoted to a third position keeps third outlet 60*c* open and opens second outlet 60*b* to permit water to discharge from the apertures 14 above upper conduit 56 as well as those above and below lower conduit 58. The handle 62 when pivoted to a fourth position closes third outlet 60*c* and keeps second outlet 60*b* in an open condition.

The handle 62 when in a fifth position has outlets 60*a*, 60*b* and 60*c* in open positions. Handle 62 when pivoted to a sixth position closes third outlet 60*c* and maintains first and second outlets 60*a* and 60*b* in open positions. The handle 62 when in a seventh position closes second and third outlets 60*b*, 60*c* but keeps first outlet 60*a* in an open position.

From the above description of the third form C, it will be seen that the invention has great flexibility of use, permitting jets of water to discharge from apertures 54 at less that line pressure to provide upper and lower body showers, both with and without discharge of water from head 66.

The use and operation of the invention has been described previously in detail and need not be repeated.

I claim:

1. A preformed body stall shower structure that includes:

a. a vertically disposable panel formed from a water resistant material that has a plurality of laterally spaced, longitudinally extending rows of apertures therein said panel having forward and rearward sides and capable of defining at least a portion of a stall shower;

b. a plurality of conduits of semi-circular transverse cross section that are bonded to said rearward side ends, with a portion of said conduits being longitudinally disposed and cooperating with said rearward side to define a plurality of longitudinally extending first confined spaces, and at least one of said conduits being transversely disposed and defining a second confined space in communication with said first confined spaces;

c. a manually operable position valve having an inlet and at least first and second outlets, said valve supported from said panel;

d. a shower head;

e. a first pipe connected to said first outlet and supporting head at an elevated position adjacent said forward side of said panel; and f. a second pipe connected to said second outlet and to said second confined space, with said multi-position valve selectively permitting the flow of water through said valve to be obstructed, to permit flow of water to said head alone, to permit flow of water to said head and to said second confined space to take place concurrently, and to permit flow of water to said second confined space only, with jets of water discharging from said apertures at less than line pressure when the flow of water into said second confined space is less than the rate of flow of water through said apertures, and said jets at less than line pressure being achievable both when water discharges from said head and does not discharge from said head.

2. A shower structure as defined in claim 1 in which said second confined space is in communication with the lower extremities of said first confined spaces.

3. A shower structure as defined in claim 1 in which said second confined space is in communication with said first confined spaces intermediate the ends thereof.

4. A shower structure as defined in claim 1 in which said multi-position valve has first, second and third outlets and a pair of spaced transverse conduits that defined a pair of spaced second and third confined spaces that are in communication with said first confined spaces, said second pipe connected to said second outlet and in communication with said second confined spaces and said shower structure in addition including; and g. a third pipe in communication with said third outlet and said third confined space, with said valve when in various positions selectively permitting flow of water from desired portions of said apertures at less than line pressure and both with and without water discharging from said head.

* * * * *